United States Patent [19]

Seibt et al.

[11] 4,198,935

[45] Apr. 22, 1980

[54] WATER-COOLED INTERNAL COMBUSTION ENGINE

[75] Inventors: Hans Seibt, Gochsheim; Rudolf Schlenz, Euerbach, both of Fed. Rep. of Germany

[73] Assignee: Fichtel & Sachs AG, Schweinfurt, Fed. Rep. of Germany

[21] Appl. No.: 883,324

[22] Filed: Mar. 3, 1978

[30] Foreign Application Priority Data

Mar. 9, 1977 [DE] Fed. Rep. of Germany ..... 7707211

[51] Int. Cl.[2] ..... F01P 5/12

[52] U.S. Cl. ..... 123/41.44; 123/41.47; 123/195 A; 123/198 C

[58] Field of Search ..... 123/41.44, 41.45, 41.46, 123/41.47, 195 A, 195 C, 198 R, 198 C, 65 R, 65 B; 184/6.28

[56] References Cited

U.S. PATENT DOCUMENTS

| | | | |
|---|---|---|---|
| 1,295,234 | 2/1919 | Szekely | 123/41.47 |
| 1,456,461 | 5/1923 | Page | 184/6.28 |
| 1,461,711 | 7/1923 | Bull | 123/41.47 |
| 2,963,006 | 12/1960 | Karde | 123/41.47 |
| 3,001,517 | 9/1961 | Baker | 123/41.47 |
| 3,903,995 | 9/1975 | Irgens | 123/192 B |
| 3,961,614 | 6/1976 | Rameau | 123/195 A |
| 4,000,666 | 1/1977 | Ito et al. | 184/6.28 |

*Primary Examiner*—Ronald H. Lazarus
*Assistant Examiner*—Jeffrey L. Yates
*Attorney, Agent, or Firm*—Toren, McGeady and Stanger

[57] ABSTRACT

In an internal combustion engine its crankcase defines an oil reservoir and a pump receptacle. A crankshaft journaled in the crankcase carries a crank in the reservoir. A cylinder fixedly mounted on the crankcase is formed with a cooling jacket which communicates with the pump receptacle through communicating bores in the cylinder and crankcase. A pump shaft rotatably secured in the crankcase in the receptacle carries an impeller for common rotation about an axis parallel to the axis of rotation of the crankshaft, and the motion transmitting input member of a drive train, a toothed wheel, is mounted on the crankshaft next to a spur gear which meshes with a spur gear on the pump shaft.

5 Claims, 3 Drawing Figures

WATER-COOLED INTERNAL COMBUSTION ENGINE

This invention relates to internal combustion engines, and particularly to an internal combustion engine which is water-cooled, and has elements of the water pump which are integral parts of the stationary engine assembly.

A commercially available motorcycle engine (Suzuki) is equipped with three water-cooled cylinders and with a rotary water pump built into the stationary part of the engine assembly. The pump shaft is upright and is driven from the normally horizontal crankshaft of the engine by a transmission including a countershaft.

It is a primary object of this invention to provide a water-cooled internal combustion engine combining the known advantages of a water pump partly integral with other engine elements with a simpler drive arrangement, and thereby to reduce the cost of building and installing the cooling system.

With this object and others in view, the invention provides a pump receptacle in the crankcase of an engine, and a pump assembly in the receptacle includes a pump shaft secured to the crankcase for rotation about an axis spacedly parallel to the axis of crankshaft rotation, and meshingly engaged spur gears on the crankshaft and the pump shaft, one of the spur gears being mounted on the portion of the crank shaft which also carries the drive wheel which is the input member of the drive train connecting the engine to a driven wheel.

It is an important advantage of this invention that driving power can be transmitted from the crankshaft to the pump shaft by spur gears which are inexpensive stable articles of commerce. The pump receptacle and the crankshaft bearings may be formed in the crankcase in the same operating step. The radial alignment of the two spur gears is not critical. If certain dimensional relationships between the drive wheel and elements of the water pump are maintained, the moving elements of the pump may be removed or replaced without disturbing any other part of the engine, as will presently be shown in detail.

Other features, additional objects, and many of the attendant advantages of this invention will readily be appreciated as the same becomes better understood by reference to the following detailed description of preferred embodiments when considered in connection with the appended drawing in which.

Figure 1:
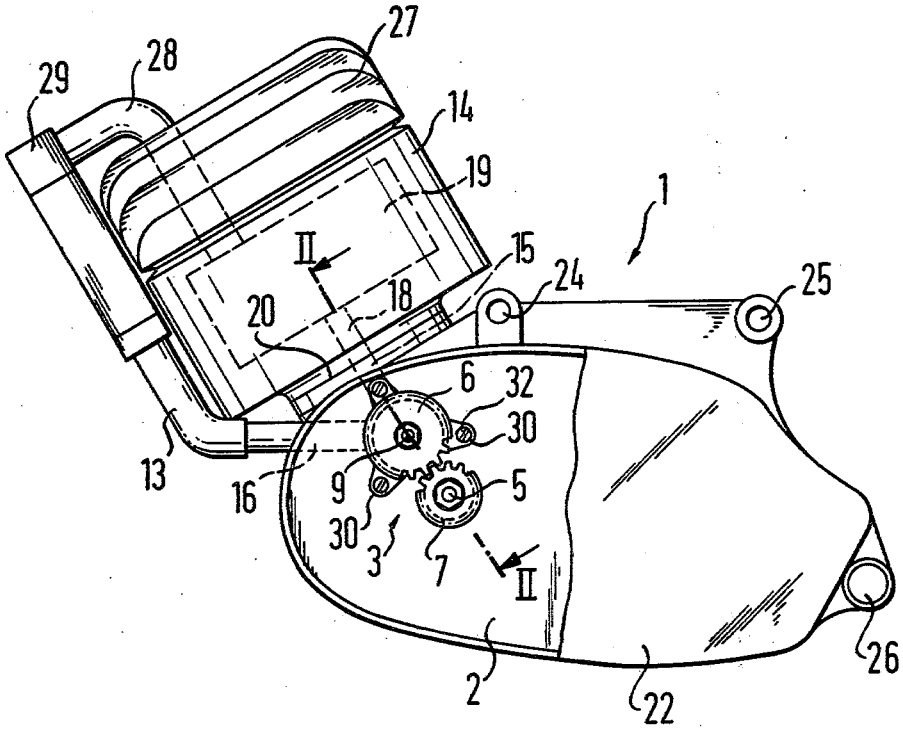
FIG. 1 shows an engine of the invention in side elevation, portions of a cover being broken away to reveal internal structure.

Referring now to the drawing in detail, and initially to FIG. 1, there is shown as much of a one-cylinder motorcycle engine 1 as is needed for an understanding of the invention. The crankcase 2 of the engine is provided with apertured lugs 24,25,26 which permit the engine to be fastened to the frame of a motorcycle or moped. A cover 22 on the crankcase 2 is partly broken away to reveal normally hidden elements. A cylinder 14 engages the crankcase 2 along an interface 20 and carries a cylinder head 27, the crankcase and head being attached to the cylinder 14 by screws, as is conventional and not shown. A cooling jacket 19 in the wall of the cylinder is connected by a hose 28 with a radiator 29, and another hose 13 connect the radiator with the suction or intake conduit 16 of a pump 3. A bore 15 in the crankcase 2 and a communicating bore 18 in the cylinder wall connect the output side of the pump 3 with the jacket 19 so that cooling water may be circulated by the pump 3 through the jacket 19 and radiator 29.

Figure 2:
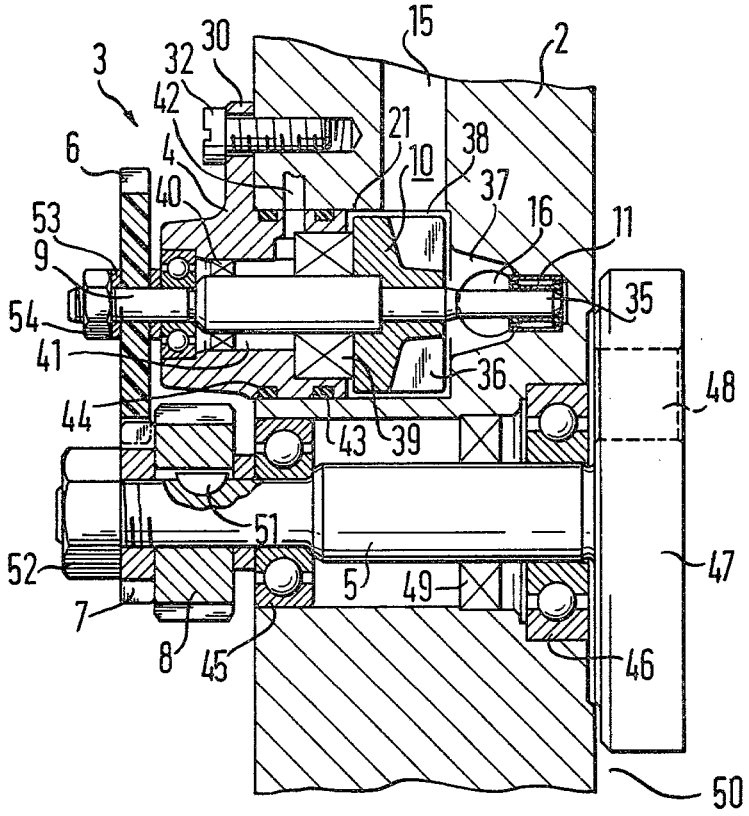
FIG. 2 is a sectional view of a portion of the engine of FIG. 1 on a larger scale, taken on the line in FIG. 1.

The pump 3 is shown in more detail in FIG. 2 from which the cover 22 was omitted. The crankcase 2 defines an oil reservoir 50 as is conventional, but is also formed with a receptacle 21 which is of circular cross section about an axis spacedly parallel to the axis of rotation of the engine crankshaft 5. The receptacle 21 is sealed axially by a casing 4 having the shape of a tubular plug attached to the outer face of the crankcase 2 by lugs 30 and screws 32. A pump shaft 9 is coaxially mounted on the crankcase 2 in the receptacle 21 by means of an anti-friction bearing 12 in the casing 4 and a sleeve bearing 11 in the conically tapering, inner end 37 of the receptacle 21 which receives the reduced inner end portion 35 of the shaft 9. The shaft 9 carries an impeller 10 having radial vanes 36 in a generally cylindrical part 38 of the receptacle 21 free from the casing 4. The intake conduit 16 terminates in the receptacle part 37. The output conduit 15 of the pump is radially aligned with the vanes 36 and communicates with the receptacle part 38.

Sealing rings 43,44 between the casing 4 and the wall of the receptacle 21, and a gasket 39 in the casing 4 about the shaft 9 impede leakage of water from the pressure zone in the pump, and water axially penetrating the gasket 39 is discharged from an annular chamber 41 about the shaft 9 through communicating bores 42 in the casing 4 and crankcase 2 to the atmosphere, the chamber 41 being further sealed axially from the bearing 12 by a gasket 40.

The drive end of the crankshaft 5 seen in FIG. 2 is journaled in the crankcase 2 by anti-friction bearings 45,46, and a gasket 49 between the bearings 45,46 prevents escape of oil from the reservoir 50 in the crankcase along the shaft 5. A web 47 on the illustrated portion of the shaft 5 is provided with a bore 48 receiving a non-illustrated crank pin, and it will be understood that a piston in the cylinder 14 is coupled to the crank pin by a connecting rod in a conventional manner not directly relevant to this invention.

The portion of the crankshaft 5 projecting outward of the oil reservoir 50 toward the cover 22, omitted from FIG. 2, carries a drive gear 8 which is the input member of the conventional drive train associated with the engine, not otherwise illustrated. It includes a clutch whose driven member is meshingly connected to the drive gear 8, a multiple-speed transmission and other conventional elements. The gear 8 is secured against rotation on the shaft 5 by a key 51, and is axially secured between a collar on the shaft and a spur gear 7, itself held in position by a nut 52. The gear 7 meshes with a spur gear 6 fixedly secured on a portion of the pump shaft 9 projecting beyond the casing 4 by means of a washer 53 and a nut 54. Rotation of the crankshaft 5 thus causes the pump shaft 9 and impeller 10 to rotate at the slower speed determined by the diameters of the spur gears 6,7.

The transverse spacing of the axes of rotation of the shafts 5,9 minus the outer radius of the drive gear 8 is greater than the radius of the cylindrical, axially terminal part of the receptacle 21 which is also smaller than the spacing of the axes minus the external radius of the spur gear 7. Because of these dimensional relationships, the casing 4 together with the shaft 9, the impeller 10, the gear 6, the bearing 12, and the associated sealing elements may be withdrawn from the receptacle 21 as a unit after the screws 32 are released if the movable pump elements need servicing or replacement.

Figure 3:
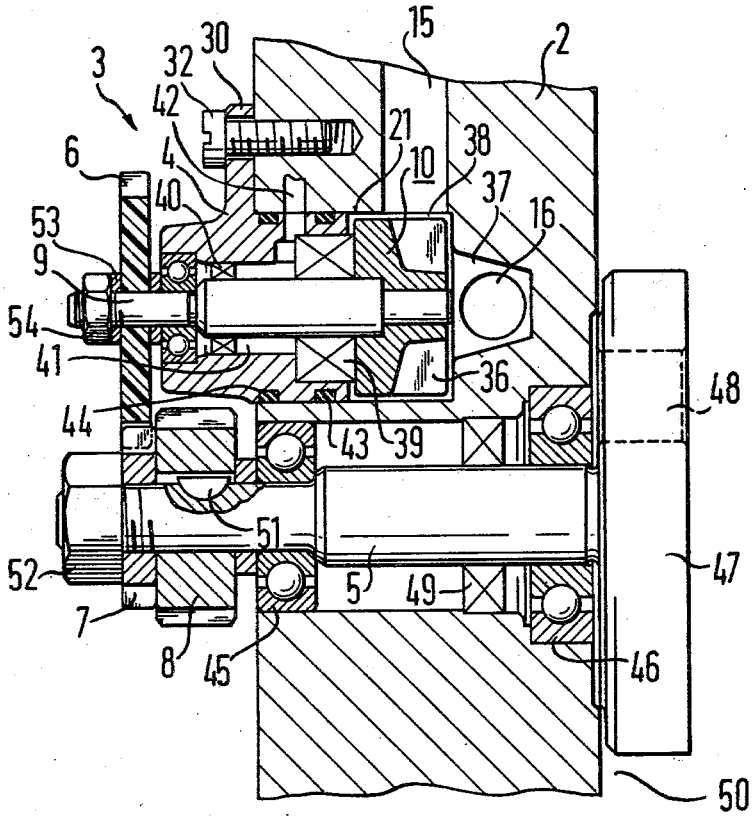
FIG. 3 illustrates a modification of the engine in a view corresponding to that of FIG. 2.

As is shown in FIG. 3, the bearing 11 may be dispensed with, and the shaft 9 shortened correspondingly in an otherwise identical engine, thereby further facilitating the removal and installation of the pump assembly.

The gear 8 has been shown and described as the input member of the drive train associated with the crankshaft 5, but it will be appreciated that any other wheel, toothed or otherwise, may transmit motion from the shaft to other elements of the drive train in a known manner without affecting the advantages derived from this invention.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. An internal combustion engine comprising:

(a) a crankcase defining therein an oil reservoir and a pump receptacle separate from said oil reservoir, said crankcase having a side wall defining one exterior surface;

(b) a crankshaft journaled in said crankcase for rotation about a first axis and carrying a crank in said reservoir; (c) a cylinder fixedly mounted on said crankcase and formed with a cooling jacket, said cylinder and said crankcase being formed with respective, communicating bores connecting said pump receptacle to said jacket; (d) a pump assembly located in said pump receptacle including a pump shaft secured to said crankcase for rotation about a second axis spaced laterally from and parallel to said first axis, and an impeller mounted on said pump shaft; (e) drive train means for transmitting the output of said engine to a driven wheel and including a motion transmitting member fixedly mounted on said crankshaft outside said crankcase adjacent to the exterior surface of said side wall of said crankcase; and (f) a first gear on said crankshaft and a second spur gear mounted on said pump shaft and said first and second spur gear disposed in meshing engagement with each other for turning said pump shaft in response to rotation of said crankshaft, said first spur gear on said crankshaft adjacent to said motion transmitting member in the direction of said first axis said second spur gear located outside said crankcase, said receptacle extending through said side wall into said crankcase and being sealed from said oil reservoir and being accessible only from the exterior of said side wall of said crankcase.

2. An engine as set forth in claim 1, wherein said motion transmitting member is a drive gear, said receptacle is of circular cross section about said second axis and has a maximum diameter smaller than the spacing of said axes minus the radius of said drive gear, said diameter being also smaller than said spacing minus the radius of the first spur gear on said crankshaft.

3. An engine as set forth in claim 2, wherein said pump assembly further includes a casing dimensioned for movement into and out of said receptacle in the direction of said second axis, said pump shaft being mounted rotatably on said casing, and axially secured to said casing for movement therewith in said direction, and fastening means releasably fastening said casing to said crankcase.

4. An engine as set forth in claim 3, wherein said assembly further includes a bearing interposed between said pump shaft and said casing, said casing constituting the sole means securing said pump shaft to said crankcase.

5. An engine as set forth in claim 4, wherein respective, axially terminal parts of said crankshaft and pump shaft project outwardly through said side wall from said oil reservoir and said receptacle, the outwardly projecting terminal part of said crankshaft carrying the first spur gear and said drive gear, and the outwardly projecting terminal part of said pump shaft carrying the second spur gear.

* * * * *